US008499392B2

(12) United States Patent
Suel, II et al.

(10) Patent No.: US 8,499,392 B2
(45) Date of Patent: Aug. 6, 2013

(54) APPARATUS AND METHOD FOR DETECTING UNBALANCED LOADS IN A WASHING MACHINE

(75) Inventors: Richard D. Suel, II, Louisville, KY (US); David Duane Warmuth, Louisville, KY (US); David Scott Dunn, Smithfield, KY (US); Jerrod Aaron Kappler, Louisville, KY (US); Meher P. Kollipara, Louisville, KY (US); Mariano Pablo Filippa, Northville, MI (US)

(73) Assignee: General Electric Company, Schenectady, NY (US)

( * ) Notice: Subject to any disclaimer, the term of this patent is extended or adjusted under 35 U.S.C. 154(b) by 335 days.

(21) Appl. No.: 12/869,190

(22) Filed: Aug. 26, 2010

(65) Prior Publication Data

US 2011/0185513 A1 Aug. 4, 2011

Related U.S. Application Data

(60) Provisional application No. 61/299,542, filed on Jan. 29, 2010.

(51) Int. Cl.
*D06F 33/02* (2006.01)

(52) U.S. Cl.
USPC ..... 8/159

(58) Field of Classification Search
USPC ..... 8/158–159; 68/12.06, 23.1, 23.3
See application file for complete search history.

(56) References Cited

U.S. PATENT DOCUMENTS

| | | | | |
|---|---|---|---|---|
| 5,070,565 | A | 12/1991 | Sood et al. | |
| 5,181,398 | A * | 1/1993 | Tanaka et al. | 68/12.06 |
| 5,301,522 | A * | 4/1994 | Ikemizu et al. | 68/12.06 |
| 5,671,494 | A * | 9/1997 | Civanelli et al. | 8/159 |
| 5,970,555 | A * | 10/1999 | Baek et al. | 8/159 |
| 5,979,194 | A * | 11/1999 | Matsumoto et al. | 68/12.04 |
| 6,023,854 | A | 2/2000 | Tsunomoto et al. | |
| 6,158,072 | A * | 12/2000 | Baek et al. | 8/159 |
| 6,240,586 | B1 | 6/2001 | Joo | |
| 6,282,965 | B1 * | 9/2001 | French et al. | 73/660 |
| 6,422,047 | B1 | 7/2002 | Magilton | |
| 6,715,175 | B2 * | 4/2004 | Ciancimino et al. | 8/159 |
| 2002/0035757 | A1 * | 3/2002 | Ciancimino et al. | 8/159 |
| 2004/0211009 | A1 | 10/2004 | Murray et al. | |
| 2005/0016227 | A1 * | 1/2005 | Lee | 68/12.04 |
| 2005/0086743 | A1 | 4/2005 | Kim et al. | |
| 2007/0039106 | A1 | 2/2007 | Stansel et al. | |
| 2007/0044247 | A1 | 3/2007 | Park et al. | |
| 2007/0101511 | A1 | 5/2007 | Park et al. | |
| 2008/0066238 | A1 | 3/2008 | Lee et al. | |

* cited by examiner

*Primary Examiner* — Joseph L Perrin
(74) *Attorney, Agent, or Firm* — Global Patent Operation; Douglas D. Zhang

(57) ABSTRACT

An apparatus and techniques for detecting unbalanced load in a washing machine are provided. A clothes basket containing a load of clothing and rotatable about an axis is accelerated. As the clothes basket passes a first predetermined rotational speed, one of power and torque applied to the clothes basket is limited. It is determined whether the clothes basket accelerates from the first predetermined to a second predetermined rotational speed within a predetermined time. Failure to reach the second predetermined rotational speed within the predetermined time signifies an out-of-balance condition as to the load of clothing. No resonance of the machine lies between the first and second predetermined rotational speeds. In another aspect, a similar technique can be employed, with or without limiting power or torque, wherein a resonance does lie between the first and second predetermined rotational speeds.

15 Claims, 7 Drawing Sheets

| DIST LOAD | DIST LOAD HEIGHT | OOB LOAD HEIGHT | OOB LOAD | GO/NO GO |
|---|---|---|---|---|
| 0 LBS | 0" | 6.5" | 7 LBS | GO |
| 0 LBS | 0" | 6.5" | 8 LBS | NO GO |
| 0 LBS | 0" | 6.5" | 9 LBS | NO GO |
| 8 LBS | 3" | 6.5" | 7 LBS | GO |
| 8 LBS | 3" | 6.5" | 8 LBS | NO GO |
| 16 LBS | 4" | 8" | 6 LBS | GO |
| 16 LBS | 4" | 8" | 7 LBS | NO GO |
| 16 LBS | 4" | 8" | 8 LBS | NO GO |
| 24 LBS | 5.5" | 10.5" | 4 LBS | GO |
| 24 LBS | 5.5" | 10.5" | 5 LBS | NO GO |
| 32 LBS | 7.5" | 12" | 3 LBS | GO |
| 32 LBS | 7.5" | 12" | 4 LBS | NO GO |
| 32 LBS | 7.5" | 12" | 5 LBS | NO GO |

FIG. 4

APPARATUS AND METHOD FOR DETECTING UNBALANCED LOADS IN A WASHING MACHINE

CROSS-REFERENCE TO RELATED APPLICATIONS

This application claims the benefit of U.S. Provisional patent application Ser. No. 61/299,542, filed on Jan. 29, 2010, the complete disclosure of which is expressly incorporated herein by reference in its entirety for all purposes.

BACKGROUND OF THE INVENTION

The subject matter disclosed herein relates to appliances such as washing machines, and more particularly to detecting unbalanced loads and the like.

Washing machines typically employ a "spin" cycle to extract water from clothing. The washer basket rotates at a relatively high speed during such "spin" cycle. If the wet clothes are not distributed in a uniform manner, that is, if the load of wet clothes is out of balance, undesirable vibration will occur.

BRIEF DESCRIPTION OF THE INVENTION

As described herein, the exemplary embodiments of the present invention overcome one or more disadvantages known in the art.

One aspect of the present invention relates to a method comprising the steps of: accelerating a clothes basket rotating about an axis, the clothes basket containing a load of clothing; as the clothes basket passes a first predetermined rotational speed, limiting one of power and torque applied to the clothes basket to a level less than a maximum available level of one of power and torque; determining whether the clothes basket reaches a second predetermined rotational speed within a predetermined time; and, responsive to the clothes basket not reaching the second predetermined rotational speed within the predetermined time, determining that an out-of-balance condition exists as to the load of clothing. The second predetermined rotational speed is greater than the first predetermined rotational speed. No resonance of the machine lies between the first and second predetermined rotational speeds.

Another aspect relates to a method comprising the steps of: accelerating a clothes basket rotating about an axis to a first predetermined rotational speed, the clothes basket containing a load of clothing; determining whether the clothes basket reaches a second predetermined rotational speed within a predetermined time from reaching the first predetermined rotational speed; and, responsive to the clothes basket not reaching the second predetermined rotational speed within the predetermined time from reaching the first predetermined rotational speed, determining that an out-of-balance condition exists as to the load of clothing. The second predetermined rotational speed is greater than the first predetermined rotational speed. A resonance of the machine lies between the first and second predetermined rotational speeds.

Yet another aspect relates to an apparatus comprising: a clothes basket rotatable about an axis; a motor coupled to the clothes basket; a sensor configured to determine a rotational speed indicative of a rotational speed of the clothes basket; and a processor coupled to the motor and the sensor. The processor is operative to carry out one or more of the aforementioned methods.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

BRIEF DESCRIPTION OF THE DRAWINGS

In the drawings:

FIG. 4 depicts non-limiting exemplary test data;

DETAILED DESCRIPTION OF THE EXEMPLARY EMBODIMENTS OF THE INVENTION

One or more embodiments of the invention provide a method and/or apparatus to detect and prevent unbalanced washer loads from spinning beyond a desirable spin speed. In at least some instances, this is achieved by limiting the available motor torque (or power) during the spin ramp-up between a predetermined range of angular velocities; by way, of example and not limitation 150-210 RPM (basket speed). If the load is sufficiently balanced, the loaded basket will accelerate through this region successfully within a given amount of time. If the loaded basket is unbalanced, there will be insufficient torque (or power) to accelerate the unbalanced load beyond the predetermined angular velocity range and the loaded basket will "stall" (not accelerate past the range). If the load is determined to have stalled or is taking an excessive amount of time to pass through the angular velocity range, the load is considered unbalanced and corrective action is taken. The corrective action may be, by way of example and not limitation, reduction of spin speed, clothes redistribution, or any other action deemed appropriate.

Thus, in one or more embodiments, torque or power is limited for a particular speed range and the amount of time it takes to accelerate through the speed range is measured. If the basket takes too long to accelerate through the predetermined speed range, then the load is considered to be unbalanced. This technique may be implemented for multiple speed ranges and may also be repeated multiple times.

It should be noted that the skilled artisan will be familiar with the well-known formula relating power and torque, namely power=torque times angular velocity. Thus, a specification of a given torque limit in a certain RPM range is in essence also a specification of a certain power, and vice versa.

Figure 1:
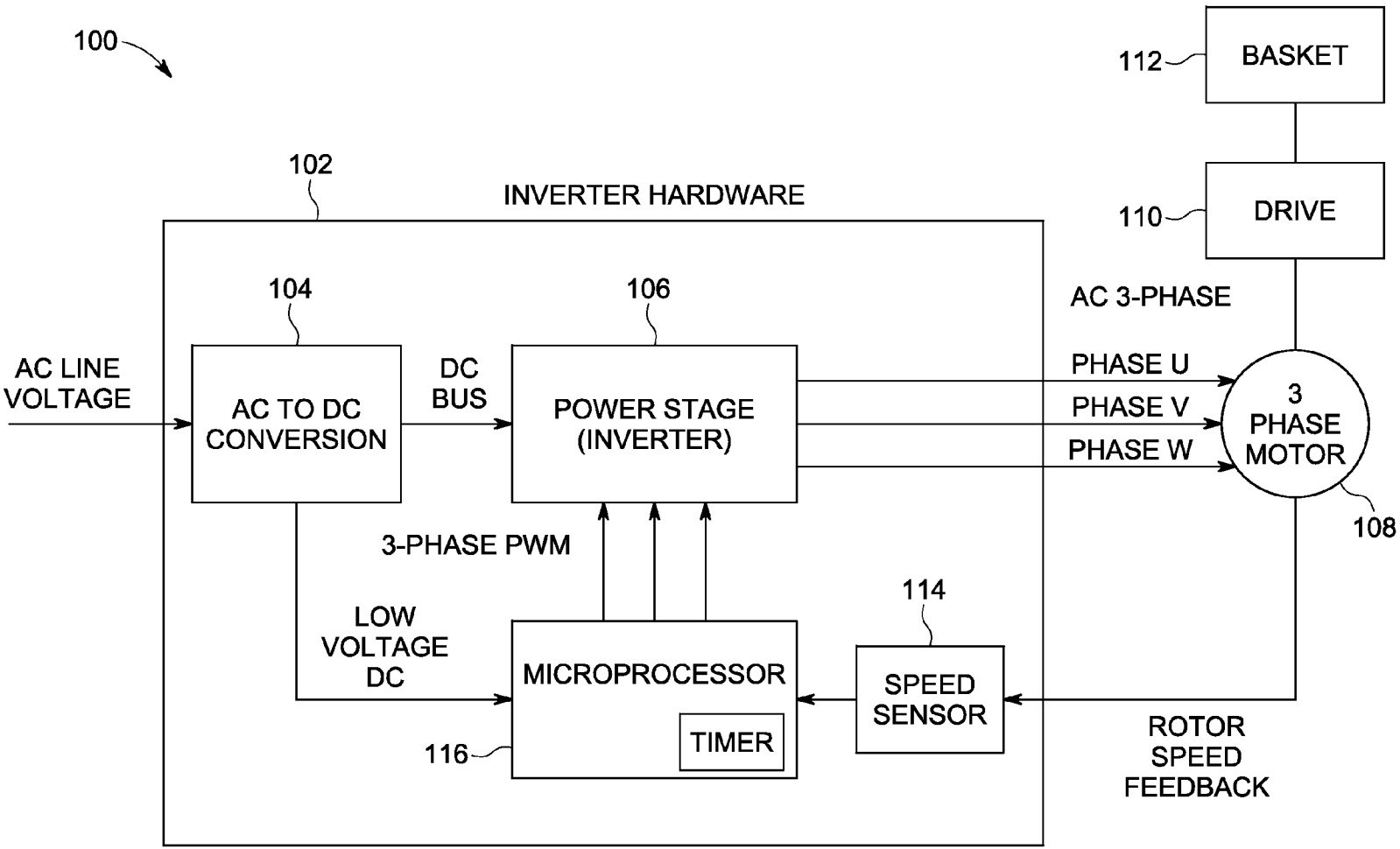
FIG. 1 is a block diagram of an exemplary system, in accordance with a non-limiting exemplary embodiment of the invention.

Reference should now be had to block diagram 100 of FIG. 1. AC line voltage is supplied to inverter hardware 102. The AC is converted to DC in block 104 using a rectifier or the like. Relatively high voltage DC is provided to a DC power bus and then to inverter 106 to provide 3-phase AC to 3-phase motor 108. Relatively low voltage DC is provided to microprocessor 116 which can include a suitable timer (not separately numbered). Motor 108 is coupled to basket 112 for receiving clothes to be washed, with a suitable drive 110. While in theory there could be a direct coupling, in practice, a suitable reduction arrangement is preferably employed, such as a pulley and belt arrangement, gearing, or the like, wherein basket 112 turns at a lower RPM than motor 108. In a specific non-limiting example, the reduction is about 13.2 such that the RPM of basket 112 must be multiplied by 13.2 to obtain the motor shaft speed. Unless otherwise noted, the RPM values given herein are for the basket 112. A suitable sensor 114 is employed to provide feedback regarding the basket RPM value (or motor RPM value, since the relationship between the two is known based on the reduction of drive 110) to microprocessor 116. Microprocessor 116 is programmed, for example, with suitable software or firmware, to implement one or more techniques as described herein. In other embodiments, an ASIC or other arrangement could be employed.

The skilled artisan will be familiar with conventional washer systems and given the teachings herein will be enabled to make and use one or more embodiments of the invention; for example, by programming a microprocessor 116 with suitable software or firmware.

In a non-limiting embodiment, microprocessor 116 senses the RPM value from speed sensor 114 and limits the amount of torque (or power) in a predetermined RPM range, say, between 150-210 RPM, to prevent significantly out-of-balance (OOB) loads from making it through the predetermined RPM range. Accordingly, the task of controlling the power and/or torque is carried out via the microprocessor 116 (through the power stage inverter 106). The skilled artisan will appreciate that in order to accelerate through the predetermined range, an OOB load requires more torque (or power) than is allowed by the torque (or power) limit, and thus by limiting the motor torque to a level sufficient to accelerate a balanced load through the predetermined angular velocity range, but less than that required to accelerate an OOB load through the RPM range within a predetermined amount of time, the motor 108 will not satisfactorily accelerate through the predetermined RPM range.

Additionally, the microprocessor 116 (controlled by suitable software or firmware) analyzes the amount of time that the motor 108 takes to pass through the RPM range (e.g., using a suitable timer, not separately numbered). If the load takes longer than the allowed time threshold, it is considered to be OOB.

In a preferred approach, the predetermined RPM range is between the first and second resonant frequencies of the machine (the first resonant frequency might be, for example, Res1=~80 RPM, and the second resonant frequency might be, for example, Res2=~278 RPM). Accordingly, it should be known if the load is OOB before reaching the second resonant frequency.

As used herein, a clothes washer refers to a system with a rotating clothes container. The axis of rotation of the clothes container may be vertical (e.g., top load), substantially horizontal (e.g., front load), or may even have an intermediate value. Typically, the system will include washing and spinning cycles, but one or more embodiments are applicable to systems with only a spin cycle; e.g., an extraction machine.

As noted, the rotational speed (angular velocity) of the basket (clothes container) 112 and/or the motor 108 is a significant parameter. It may be specified in RPM, radians per second, and so on. In a power (or torque) limiting region, the applied motor power (or torque) is limited to less than the maximum available power (or torque) at a given speed. A speed range refers to rotational velocity of either the motor output shaft or the clothes container for detecting an out of balance load.

Again, an out of balance (OOB) load is an unbalanced load that results in an undesirable machine response such as vibration or noise. As will be explained in greater detail below with respect to FIG. 3, in some instances, an OOB load is detected before rotational velocity reaches a system resonant frequency (e.g., before the second resonance). In other instances, an OOB load is detected at a system resonant frequency (e.g., at or near the second resonance). In still other instances, combinations of the preceding two aspects may be employed during the same wash cycle.

Figure 5:
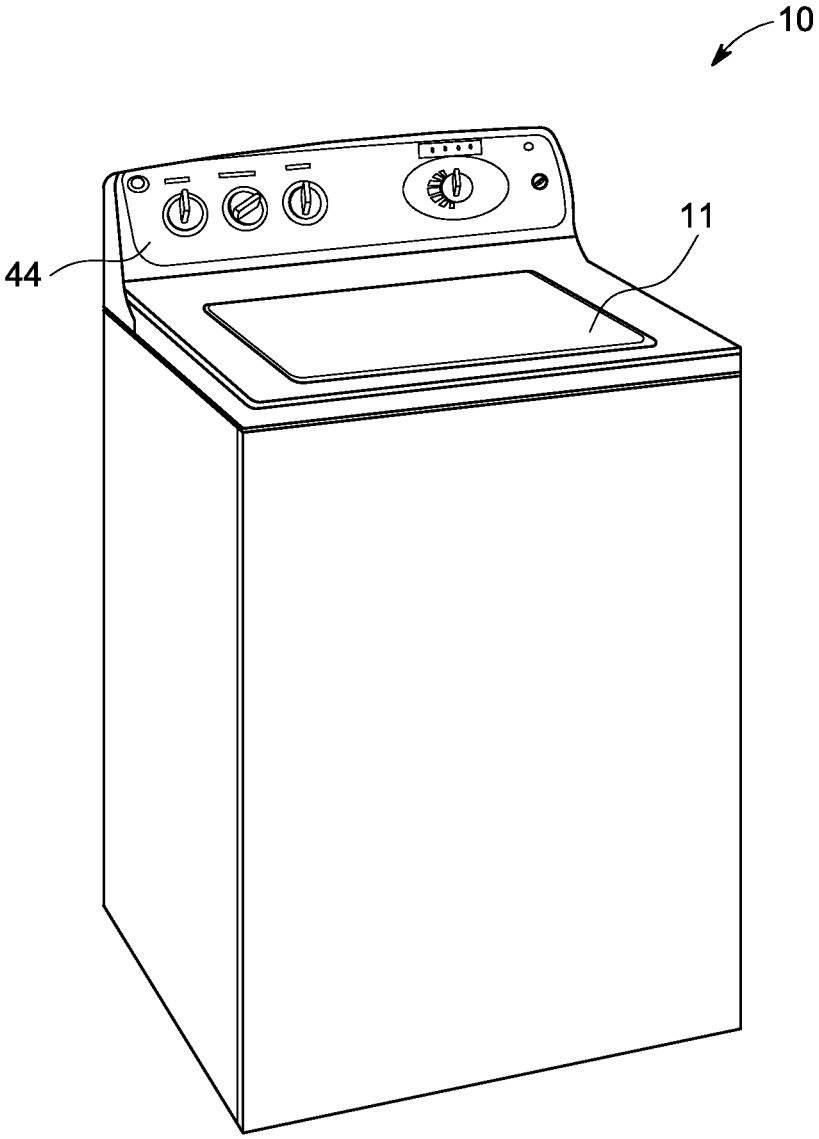
FIG. 5 is a pictorial view of an exemplary top-loading washing machine.

FIG. 5 shows an exemplary top-loading washing machine 10 including a control panel or portion 44 and a loading door 11. Machine 10 is a non-limiting example of a machine with which one or more aspects of the invention may be implemented.

Figure 6:
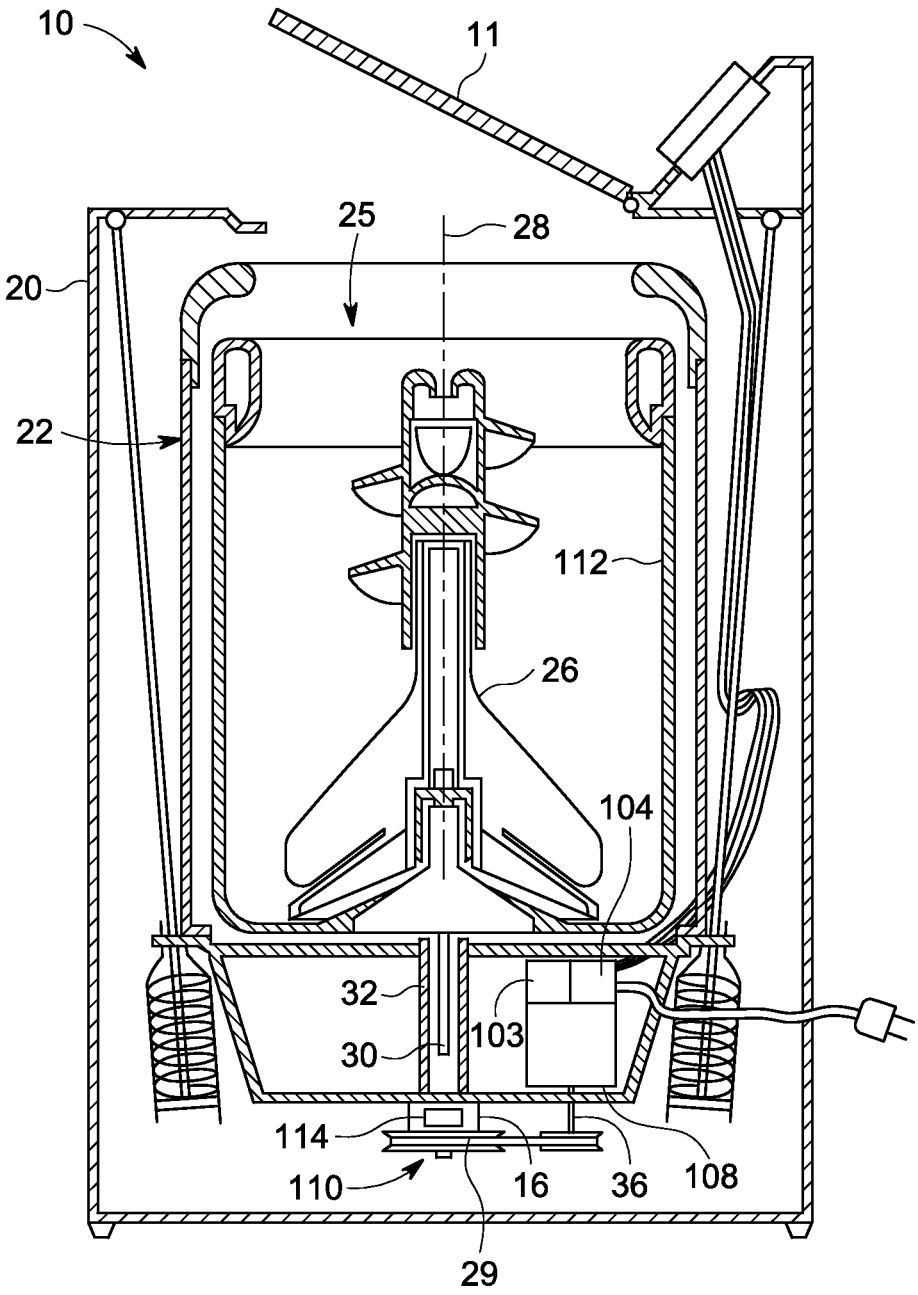
FIG. 6 is a cross-sectional side elevation of an exemplary top-loading washing machine similar to that depicted in FIG. 5.

FIG. 6 shows a cross-sectional side elevation of an exemplary top-loading washing machine 10 similar to that depicted in FIG. 5. Clothes are loaded through door 11 into clothes-receiving opening 25. The machine has an external cabinet 20. A structure 22 is suspended with springs (not separately numbered) and includes basket 112 and agitator 26 revolving about axis 28. The basket 112 is driven by motor 108 via drive arrangement 110; in this case, the latter includes a pulley mounted to motor drive shaft 36 connected by belt 29 to a pulley mechanically linked to basket driveshaft 30 and spin tube 32, which are concentric shafts. Driveshaft 30 is directly coupled to the pulley and belt 29, and drives the agitator. Spin tube 32 is directly coupled to the basket 112. A clutch locks elements 30 and 32 together during spin. Speed sensor 114 is provided on motor driveshaft 36. Motor 108 is controlled by a control unit 103 which may include components such as 104, 106, and 116. As would be appreciated by one skilled in the art, FIG. 6 serves merely as an example, and, as such, additional and/or separate embodiments can be implemented in connection with the invention (such as, for example, the use of an impeller, a direct drive motor, etc.). Additionally, one or more embodiments of the invention can be implemented with additional types of motors such as, a permanent magnet, a direct drive motor, or any motor driven by an inverter.

Figure 8:
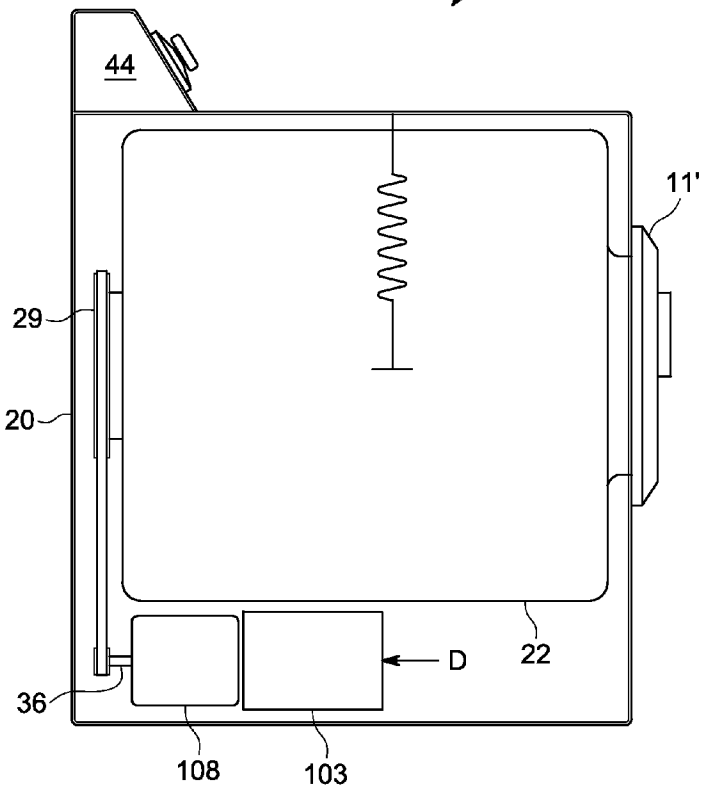
FIG. 8 is a semi-schematic cross-sectional side elevation taken along line VIII-VIII of FIG. 7.
Figure 7:
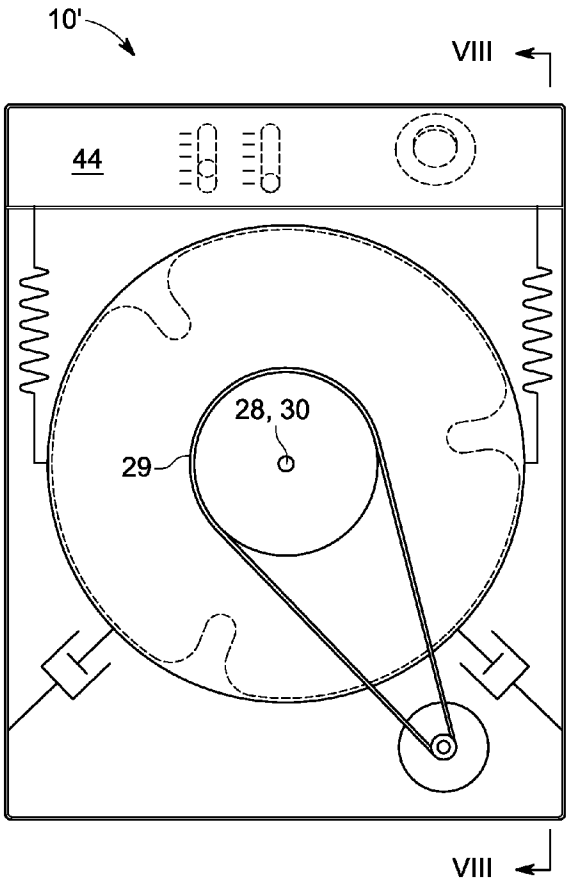
FIG. 7 is a semi-schematic rear elevation of an exemplary front-loading washing machine.

FIG. 7 is a semi-schematic rear elevation of an exemplary front-loading washing machine 10' and FIG. 8 is a semi-schematic cross-sectional side elevation taken along line VIII-VIII of FIG. 7. Machine 10' is another non-limiting example of a machine with which one or more aspects of the invention may be implemented. Clothes are loaded through door 11'. The machine has an external cabinet 20 and a control panel or portion 44. A structure 22 is suspended with springs and dampers (not separately numbered) and may include a basket and agitator revolving about axis 28. The basket is driven by motor 108 via a drive arrangement; in this case, the latter includes a pulley mounted to motor drive shaft 36 connected to a pulley mounted to basket driveshaft 30 by belt 29. A speed sensor can be provided. Motor 108 is controlled by a control unit 103 which may include components such as 104, 106, and 116.

Figure 2:
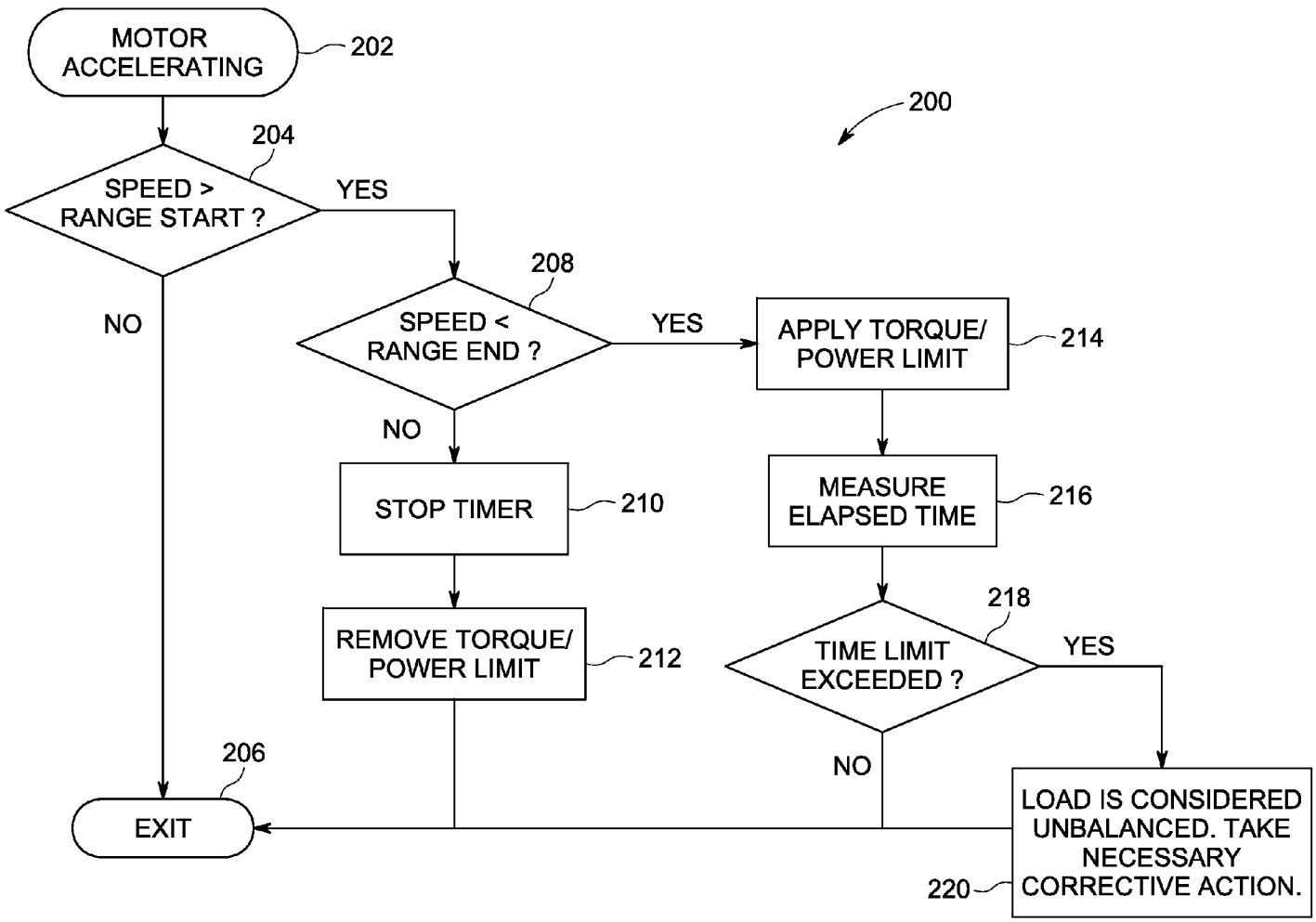
FIG. 2 is a flow chart of an exemplary method, in accordance with a non-limiting exemplary embodiment of the invention.

Refer now to flow chart 200 of FIG. 2. In block 202, motor 108 is accelerating. In decision block 204, determine if one of the predetermined speed ranges has been entered. If not, exit in block 206. If so, as per the yes branch, proceed to decision block 208 and determine whether the speed is less than the range end (i.e., predetermined speed range has not yet been successfully traversed); if not, as per the "no" branch, then the predetermined speed range has been successfully traversed and the timer is stopped in block 210 and the torque or power limit is removed in block 212, followed by exit as per block 206. On the other hand, if so, as per the "yes" branch, then the predetermined speed range has not yet been successfully traversed, so apply the torque or power limit in block 214 and monitor the elapsed time in block 216 with the timer of microprocessor 116. If the time limit is exceeded, as per the yes branch of block 218, the load is unbalanced as in block 220 and appropriate corrective action can be taken. If the time limit is not exceeded during this pass through the routine, then exit as per block 206, and the system can, in one or more embodiments of the invention, periodically re-enter this routine at 202 and proceed through 204, 208, 214, 216 and 218, until either the time limit is exceeded at 218, indicating an unbalanced load, or the speed exceeds the range end at 208 before the time limit is exceeded, indicating that the predetermined speed range was successfully traversed.

Figure 3:
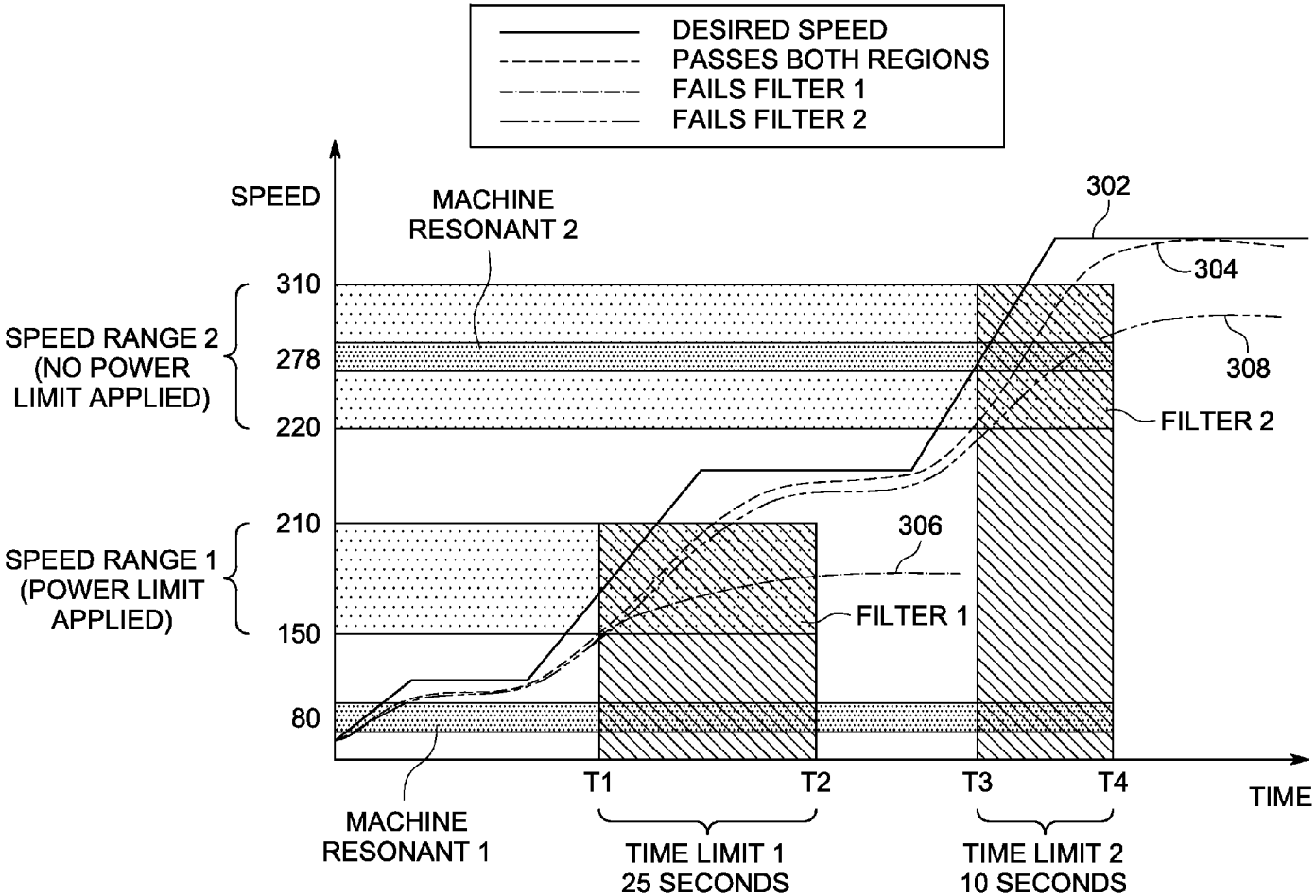
FIG. 3 is an exemplary graph of speed versus time, in accordance with a non-limiting exemplary embodiment of the invention.

With reference now to FIG. 3, basket RPM is plotted against time. The particular machine of the illustrative embodiment exhibits a first resonance near 80 RPM and a second resonance near 278 RPM. Solid line 302 shows the desired basket RPM (that is, an example RPM curve that successfully proceeds without failing either filter 1 or filter 2) as a function of time. By way of illustration, curve 302 includes plateaus to depict, by way of example, speed control for water extraction (from the clothing) moments of a cycle. Line/curve 304 represents a successful spin that proceeds without failing either filter 1 or filter 2. Lines/curves 306 and 308 represent example RPM curves that proceed such that they do not successfully pass filter 1 and filter 2, respectively. In a first predetermined RPM range, from 150 to 210 RPM, a first filter is employed, wherein a power (or torque) limit is imposed and wherein the basket is expected to pass through the first predetermined RPM range in no more than 25 seconds (between points T1 and T2). Here, the first range is between the first and second resonant frequencies. Curves 304 and 308 pass this first test. Curve 306 stalls and fails. In a second predetermined RPM range, from 220 to 310 RPM, a second filter is applied. In this example, no torque or power limit is applied, but the basket is expected to pass through the second predetermined range in no more than 10 seconds (between points T3 and T4). Here, the second range brackets the second resonant frequency. Curve 304 passes this second test. Curve 308 stalls and fails. The goal for filter 1, which applies a power or torque limit, is to stop an unbalanced load before it approaches a resonant (because once such a load reaches a resonant, the imbalance become amplified and the machine can produce significant vibration. With filter 2, if an unbalanced load were to reach a resonant and stall there, the lack of a power/torque limit would enable the machine to power the load through the resonant.

Thus, in one aspect, one or more embodiments of the invention provide a clothes washer that incorporates a technique that identifies a highly out of balance mass at a speed outside any resonant frequency, as shown with respect to the first filter. This technique applies a predetermined power (or torque) while accelerating through a predetermined speed range and observes if the instantaneous speed reaches a predetermined level within a predetermined time limit. In some cases, the applied power is a predetermined level; in other cases, the applied torque is a predetermined level; in still other cases, the applied power and/or torque are non linear (for example, the curve of the applied power/torque can appear more like a curve or a slope line (that is, it does not have to be flat)). The technique described with respect to Filter 1 can be repeated for multiple speed ranges and/or can be repeated at the same speed range (power may be varied during these repetitions). In some cases, the technique may be repeated multiple times at the same speed range with a varying time limit. By way of example, one or more embodiments of the invention can include using, as a starting point, very conservative power limits, and then if failures occurred, those power limits would be weakened (that is, allow more power/torque) incrementally until it is determined how much power/torque is required to send the a load through a resonance band (which also may indicate what the out of balance mass is). Accordingly, the goal and criterion used for defining a power/torque limit includes preventing a severe vibration issue caused by an imbalance.

Furthermore, in another aspect, one or more embodiments of the invention provide a clothes washer that incorporates a technique that identifies a high out of balance mass at or near a resonant frequency. As described, for example, with regard to Filter 2, this technique applies a predetermined power or torque (which in general may or may not be limited) while accelerating through a predetermined speed range that encompasses a resonant frequency and observes if the instantaneous speed reaches a predetermined level within a predetermined time limit. In some cases, the applied power is a predetermined level; in other cases, the applied torque is a predetermined level; in still other cases, the applied power and/or torque are non linear. In one or more embodiments of the invention, the criteria and/or design considerations can include determining which loads will desirably be stopped (that is, which loads should be allowed to spin up and which loads should not be allowed to spin up). The technique described with respect to Filter 2 can be repeated for multiple speed ranges and/or can be repeated at the same speed range (power may be varied during these repetitions). In some cases, the technique may be repeated multiple times at the same speed range with a varying time limit.

Filter 2 advantageously provides an additional margin of safety in the event an unbalanced load makes it through Filter 1. The goal in one or more embodiments is to attain, for loads that are not OOB, a spin speed beyond the second resonance and beyond the second filter range.

Again, in one aspect, torque (or power) is limited in a predetermined angular velocity or RPM range, such as between 150-210 basket RPM, such that balanced loads will pass through, but unbalanced loads will fail to pass through. When ramping up in the spin cycle, the machine must pass through the predetermined speed range. If the clothes load is unbalanced, the torque or power applied by motor 108 will be insufficient to accelerate through this predetermined speed region within the allowed amount of time and the motor control 103 will stop accelerating the motor 108. The microprocessor 116 (for example, under the influence of suitable firmware or software) will also monitor the time (using, e.g., the timer not separately numbered) it takes for the load to get through the predetermined speed range. If the allowed time is exceeded, the load is considered unbalanced and corrective action will be taken. This aspect advantageously catches the case where an unbalanced load may eventually make it through the predetermined speed range if given enough time.

One advantage that may be realized in the practice of some embodiments of the described systems and techniques is prevention of undesirable noise or vibration, and excessive wear to the machine caused by spinning unbalanced loads. Another advantage that may be realized in the practice of some embodiments of the described systems and techniques is ease of implementation in vertical axis washing machines that currently do not prevent spinning unbalanced loads (can also be used with machines having other orientations of the axis). Still another advantage that may be realized in the practice of some embodiments of the described systems and techniques is that there is no need to employ a position detector to detect the position of an eccentric (out of balance) load. Yet another advantage that may be realized in the practice of some embodiments of the described systems and techniques is that there is no need to look at DC bus current ripple. A still further advantage that may be realized in the practice of some embodiments of the described systems and techniques is that there is no need to detect the unbalance using mechanical devices such as accelerometers, magnets, and the like. An even further advantage that may be realized in the practice of some embodiments of the described systems and techniques is that there is no need to detect the unbalance using various motor feedback signals such as current, speed, torque, etc. to look for ripple or other variations that correlate to unbalanced loads.

Thus, one or more embodiments limit torque (or power) to "filter" out unbalanced loads during ramp-up, taking advantage of the fact that as the load becomes more unbalanced, it requires more torque (or power) to accelerate (for example, since power that would otherwise accelerate the basket instead is absorbed in the mechanical vibrations of the springs and other components of system).

One or more embodiments can be implemented in the software or firmware that controls microprocessor 116 and drives the motor 108 for the washing machine.

FIG. 4 presents non-limiting exemplary results wherein it was sought to accelerate the machine to 350 RPM. The first column is the mass of the distributed load, the second column is the height of the distributed load, as measured from the bottom of the basket, the third column is the height of the OOB load as measured from the bottom of the basket, and the fourth column is the mass of the OOB load. In the non-limiting exemplary experiment, the time measurement portion of the above-described technique was not implemented in software, so the experimental machine was manually stopped whenever the load leveled off in the torque limiting region (due to high OOB). The exemplary technique successfully stopped all severe OOB loads from spinning up beyond 210 RPM. See the last column ("GO" means successfully passed through test region; "NO GO" means stopped due to OOB). The GO/NO GO determinations facilitate in defining parameter boundaries. That is, certain load weights (balanced and OOB) at certain heights are determined to be acceptable (that is, those loads can be spun to the resonant or higher speeds, based on the vibrations). Also, the height of a load can affect the status of a load as balanced or OOB, as, for example, the higher a load is in the machine the more an out-of-balance is magnified.

In a non-limiting example, with respect to the specific power limit that is used for the first OOB (out-of-balance) filter from 150-210 RPM, the average power that could be delivered over this speed range, in the particular experimental set-up, was 313 W. When implementing the OOB detection filter, the power was limited to an average value of 50 W. Thus, with a maximum deliverable power of around 313 W, the power was deliberately limited in the predetermined range to approximately 16% of the maximum deliverable power, (50/313)*100=16%.

In one or more embodiments, when employing power or torque limiting, the power or torque should be limited to a values slightly above that which would normally be required by a properly balanced load to pass through the predetermined range. The skilled artisan will appreciate that undesirable vibrations due to an OOB condition are typically particularly severe at or near a resonant frequency, and so the filter range is selected to detect out of balance conditions before reaching resonant frequency.

Given the discussion thus far, it will be appreciated that, in general terms, an exemplary method, according to one aspect of the invention, includes the step of accelerating a clothes basket 112 of a machine such as 10 or 10'. The clothes basket rotates about an axis 28. The clothes basket contains a load of clothing. An additional step includes, as the clothes basket passes a first predetermined rotational speed (e.g., at T1), limiting power or torque applied to the clothes basket, as at 214 (for example, limiting power or torque to a level less than a maximum available level of one of power and torque). A further step includes determining whether the clothes basket reaches a second predetermined rotational speed within a predetermined time (e.g., by T2) from passing the first rotational speed, as per step 218. A still further step includes, responsive to the clothes basket not reaching the second predetermined rotational speed within the predetermined time (e.g., "YES" branch of block 220), determining that an out-of-balance condition exists as to the load of clothing. The second predetermined rotational speed is greater than the first predetermined rotational speed, and no resonance of the machine lies between the first and second predetermined rotational speeds.

Furthermore, in the event that the clothes basket does reach the second predetermined rotational speed within the predetermined time, it can be determined that the out-of-balance condition does not exist as to the load of clothing, and the limiting of power or torque applied to the clothes basket can cease, as per the "NO" branch of block 218. "Ceasing" in this context may include removing the power or torque limit or changing the power or torque limit to a different value.

In one or more instances, if no stall occurs (i.e., the clothes basket reaches the second predetermined rotational speed within the predetermined time) in the just-mentioned filter, additional steps include again accelerating the clothes basket, to a third predetermined rotational speed; determining whether the clothes basket reaches a fourth predetermined rotational speed within a predetermined time from reaching the third predetermined rotational speed; and responsive to the clothes basket not reaching the fourth predetermined rotational speed within the predetermined time from reaching the third predetermined rotational speed, determining that the out-of-balance condition exists as to the load of clothing. The fourth predetermined rotational speed is greater than the third predetermined rotational speed, and a resonance of the machine does lie between the third and fourth predetermined rotational speeds. See, e.g., curve 308.

In some cases, additional filtering could be carried out in another range that does not include a resonance. For example, responsive to the clothes basket reaching the second predetermined rotational speed within the predetermined time, in such cases, additional steps could include again accelerating the clothes basket, to a third predetermined rotational speed; and as the clothes basket passes the third predetermined rotational speed, limiting one of power and torque applied to the clothes basket. Furthermore, steps 216 and 218 could again be carried out to determine whether the clothes basket reaches a fourth predetermined rotational speed within a predetermined time from reaching the third predetermined rotational speed. If such is not the case, as per block 220, it is determined that the out-of-balance condition exists as to the load of clothing.

The fourth predetermined rotational speed is greater than the third predetermined rotational speed, the third predetermined rotational speed is greater than the second predetermined rotational speed, and as noted, no resonance of the machine lies between the third and fourth predetermined rotational speeds.

In some cases, if a stall occurs, the same range can be repeated again. Thus, in some cases, responsive to the clothes basket not reaching the second predetermined rotational speed within the predetermined time, again accelerate the clothes basket, to the first predetermined rotational speed; and as the clothes basket again passes the first predetermined rotational speed, again limit power or torque applied to the clothes basket. Again, determine whether the clothes basket reaches the second predetermined rotational speed within another predetermined time from reaching the first predetermined rotational speed. Note that the applied power or torque might be the same or different than the first time. Furthermore, the time limit might be the same or different than the first time. If the clothes basket does not reach the second predetermined rotational speed within the (same or different) predetermined time from reaching the first predetermined rotational speed, determine that the out-of-balance condition exists as to the load of clothing.

This type of repetition at the same RPM range could also be done deliberately for calibration purposes. For example, start with a very short time limit that almost any load might fail, and gradually lengthen the allowed time (or vice-versa). Similarly, start with a low torque or power that almost any load might fail, and gradually increase the torque or power (or vice-versa). By way of example, if the time is gradually lengthened or power level gradually increased, one or more embodiments of the invention can determine/ascertain what the out-of-balance is.

Furthermore, given the discussion thus far, it will be appreciated that, in general terms, another exemplary method, according to another aspect of the invention, includes the step of accelerating a clothes basket 112 of a machine such as 10, 10'. The clothes basket rotates about an axis 28. The basket is accelerated to a first predetermined rotational speed (e.g., at T3). The clothes basket contains a load of clothing. It is determined whether the clothes basket reaches a second predetermined rotational speed within a predetermined time (e.g., by T4) from reaching the first predetermined rotational speed. If such is not the case, it is determined that an out-of-balance condition exists as to the load of clothing. The second predetermined rotational speed is greater than the first predetermined rotational speed, and a resonance of the machine does lie between the first and second predetermined rotational speeds.

In some instances, power or torque is not limited near the resonance, but in other instances, this can be done, linearly or non-linearly.

The technique applied near a resonance can also be repeated in the same RPM range if desired, for calibration or, for example, responsive to the clothes basket not reaching the second predetermined rotational speed within the predetermined time. Accordingly, one or more embodiments of the invention can perform repeated implementations in order to take an average of the resulting data. Thus, it is possible to again accelerate the clothes basket, to the first predetermined rotational speed; determine whether the clothes basket reaches the second predetermined rotational speed within another predetermined time from reaching the first predetermined rotational speed; and, responsive to the clothes basket not reaching the second predetermined rotational speed within the another predetermined time from reaching the first predetermined rotational speed, determining that the out-of-balance condition exists as to the load of clothing. Again, this other predetermined time could be the same or different than the first predetermined time used for this RPM range, and torque or power limiting might or might not be applied, and if applied, could be the same or different than any previous repetition. In one or more embodiments of the invention, example implementations can be carried out to determine an appropriate time range for performing successful spins of certain loads (using both successful and failed spins as guiding parameters).

Furthermore, given the discussion thus far, it will be appreciated that, in general terms, an exemplary apparatus, according to still another aspect of the invention, includes a clothes basket 112 rotatable about an axis 28; a motor 108 coupled to the clothes basket; a sensor 114 configured to determine a rotational speed indicative of a rotational speed of the clothes basket; and a processor (e.g., microprocessor 116 or alternative) coupled to the motor and the sensor. The processor is operative to control the motor to implement one or more techniques as described herein. The axis 28 can have any orientation; in some cases, such as FIGS. 5 and 6, it may be vertical; in other cases, such as FIGS. 7 and 8, it may be horizontal.

Software includes but is not limited to firmware, resident software, microcode, etc. As is known in the art, part or all of one or more aspects of the methods and apparatus discussed herein may be distributed as an article of manufacture that itself comprises a tangible computer readable recordable storage medium having computer readable code means embodied thereon. The computer readable program code means is operable, in conjunction with a computer system or microprocessor, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer (e.g., processor 116) to read instructions and data, such as magnetic variations on a magnetic media or height variations on the surface of a compact disk. The medium can be distributed on multiple physical devices (or over multiple networks). As used herein, a tangible computer-readable recordable storage medium is intended to encompass a recordable medium, examples of which are set forth above, but is not intended to encompass a transmission medium or disembodied signal. Processor 116 may include and/or be coupled to a suitable memory.

Thus, while there have shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method comprising the steps of:

accelerating a clothes basket of a machine, said clothes basket rotating about an axis, said clothes basket containing a load of clothing;

as said clothes basket passes a first predetermined rotational speed, limiting one of power and torque applied to said clothes basket to a level less than a maximum available level of one of power and torque;

determining whether said clothes basket reaches a second predetermined rotational speed within a predetermined time from passing said first predetermined rotational speed; and responsive to said clothes basket not reaching said second predetermined rotational speed within said predetermined time, determining that an out-of-balance condition exists as to said load of clothing;

wherein said second predetermined rotational speed is greater than said first predetermined rotational speed, and wherein no resonance of said machine lies between said first and second predetermined rotational speed; and wherein said level less than said maximum available level of one of power and torque corresponds to a level sufficient to accelerate a substantially balanced load in said clothes basket to said second predetermined rotational speed within said predetermined time but less than that required to accelerate a substantially out-of-balance load in said clothes basket to said second predetermined rotational speed within said predetermined time.

2. The method of claim 1, further comprising, responsive to said clothes basket reaching said second predetermined rotational speed within said predetermined time, determining that said out-of-balance condition does not exist as to said load of clothing and ceasing said limiting of said one of power and torque applied to said clothes basket.

3. The method of claim 2, wherein said limiting comprises limiting power.

4. The method of claim 2, wherein said limiting comprises limiting torque.

5. The method of claim 2, further comprising, responsive to said clothes basket not reaching said second predetermined rotational speed within said predetermined time:

again accelerating said clothes basket, to said first predetermined rotational speed;

as said clothes basket again passes said first predetermined rotational speed, again limiting one of power and torque applied to said clothes basket;

determining whether said clothes basket reaches said second predetermined rotational speed within another predetermined time from reaching said first predetermined rotational speed; and responsive to said clothes basket not reaching said second predetermined rotational speed within said another predetermined time from reaching said first predetermined rotational speed, determining that said out-of-balance condition exists as to said load of clothing.

6. The method of claim 5, wherein, in said step of again limiting one of power and torque, said one of power and torque is varied differently than in said initial limiting of said one of power and torque.

7. The method of claim 5, wherein, in said step of determining whether said clothes basket reaches said second predetermined rotational speed within another predetermined time, said another predetermined time is different than said predetermined time from passing said first predetermined rotational speed in said initial step of determining whether said clothes basket reaches said second predetermined rotational speed within said predetermined time from passing said first predetermined rotational speed.

8. The method of claim 2, further comprising, as said clothes basket again passes said first predetermined rotational speed, limiting one of power and torque applied to said clothes basket to a different value than when said clothes basket initially passes said first predetermined rotational speed.

9. The method of claim 2, further comprising, responsive to said clothes basket reaching said second predetermined rotational speed within said predetermined time:

again accelerating said clothes basket, to a third predetermined rotational speed;

determining whether said clothes basket reaches a fourth predetermined rotational speed within a predetermined time from reaching said third predetermined rotational speed; and responsive to said clothes basket not reaching said fourth predetermined rotational speed within said predetermined time from reaching said third predetermined rotational speed, determining that said out-of-balance condition exists as to said load of clothing;

wherein said fourth predetermined rotational speed is greater than said third predetermined rotational speed, and wherein a resonance of said machine lies between said third and fourth predetermined rotational speeds.

10. The method of claim 2, further comprising, responsive to said clothes basket reaching said second predetermined rotational speed within said predetermined time:

again accelerating said clothes basket, to a third predetermined rotational speed;

as said clothes basket passes said third predetermined rotational speed, limiting one of power and torque applied to said clothes basket;

determining whether said clothes basket reaches a fourth predetermined rotational speed within a predetermined time from reaching said third predetermined rotational speed; and responsive to said clothes basket not reaching said fourth predetermined rotational speed within said predetermined time from reaching said third predetermined rotational speed, determining that said out-of-balance condition exists as to said load of clothing;

wherein said fourth predetermined rotational speed is greater than said third predetermined rotational speed, said third predetermined rotational speed is greater than said second predetermined rotational speed, and wherein no resonance of said machine lies between said third and fourth predetermined rotational speeds.

11. A method comprising the steps of:

accelerating a clothes basket of a machine, said clothes basket rotating about an axis said clothes basket containing a load of clothing;

as said clothes basket passes a first predetermined rotational speed, limiting one of power and torque applied to said clothes basket to a level less than a maximum available level of one of power and torque;

determining whether said clothes basket reaches a second predetermined rotational speed within a predetermined time from passing said first predetermined rotational speed; and responsive to said clothes basket not reaching said second predetermined rotational speed within said predetermined time, determining that an out-of-balance condition exists as to said load of clothing;

wherein said second predetermined rotational speed is greater than said first predetermined rotational speed, and wherein no resonance of said machine lies between said first and second predetermined rotational speed;

responsive to said clothes basket reaching said second predetermined rotational speed within said predetermined time, determining that said out-of-balance condition does not exist as to said load of clothing and ceasing said limiting of said one of power and torque applied to said clothes basket; and responsive to said clothes basket reaching said second predetermined rotational speed within said predetermined time again accelerating said clothes basket, to a third predetermined rotational speed;

determining whether said clothes basket reaches a fourth predetermined rotational speed within a predetermined time from reaching said third predetermined rotational speed; and responsive to said clothes basket not reaching said fourth predetermined rotational speed within said predetermined time from reaching said third predetermined rotational speed, determining that said out-of-balance condition exists as to said load of clothing;

wherein said fourth predetermined rotational speed is greater than said third predetermined rotational speed, and wherein a resonance of said machine lies between said third and fourth predetermined rotational speeds.

12. A method comprising the steps of:

accelerating a clothes basket of a machine, said clothes basket rotating about an axis, said clothes basket containing a load of clothing;

as said clothes basket passes a first predetermined rotational speed, limiting one of power and torque applied to said clothes basket to a level less than a maximum available level of one of power and torque;

determining whether said clothes basket reaches a second predetermined rotational speed within a predetermined time from passing said first predetermined rotational speed; and responsive to said clothes basket not reaching said second predetermined rotational speed within said predetermined time, determining that an out-of-balance condition exists as to said load of clothing;

wherein said second predetermined rotational speed is greater than said first predetermined rotational speed, and wherein no resonance of said machine lies between said first and second predetermined rotational speed;

responsive to said clothes basket reaching said second predetermined rotational speed within said predetermined time, determining that said out-of-balance condition does not exist as to said load of clothing and ceasing said limiting of said one of power and torque applied to said clothes basket; and responsive to said clothes basket reaching said second predetermined rotational speed within said predetermined time:

again accelerating said clothes basket, to a third predetermined rotational speed;

as said clothes basket passes said third predetermined rotational speed, limiting one of power and torque applied to said clothes basket;

determining whether said clothes basket reaches a fourth predetermined rotational speed within a predetermined time from reaching said third predetermined rotational speed; and responsive to said clothes basket not reaching said fourth predetermined rotational speed within said predetermined time from reaching said third predetermined rotational speed, determining that said out-of-balance condition exists as to said load of clothing;

wherein said fourth predetermined rotational speed is greater than said third predetermined rotational speed, said third predetermined rotational speed is greater than said second predetermined rotational speed, and wherein no resonance of said machine lies between said third and fourth predetermined rotational speeds.

13. A method comprising the steps of:

accelerating a clothes basket of a machine, said clothes basket rotating about an axis, to a first predetermined rotational speed, said clothes basket containing, a load of clothing;

as said clothes basket passes said first predetermined rotational speed, limiting one of power and torque applied to said clothes basket;

determining whether said clothes basket reaches a second predetermined rotational speed within a predetermined time from reaching said first predetermined rotational speed; and responsive to said clothes basket not reaching said second predetermined rotational speed within said predetermined time from reaching said first predetermined rotational speed, determining that an out-of-balance condition exists as to said load of clothing;

wherein said second predetermined rotational speed is greater than said first predetermined rotational speed, and wherein a resonance of said machine lies between said first and second predetermined rotational speeds; and wherein said limiting step comprises limiting one of power and torque applied to said clothes basket to a level sufficient to accelerate a substantially balanced load in said clothes basket to said second predetermined rotational speed within said predetermined time but less than that required to accelerate a substantially out-of-balance load in said clothes basket to said second predetermined rotational speed within said predetermined time.

14. The method of claim 13, further comprising, responsive to said clothes basket not reaching said second predetermined rotational speed within said predetermined time:

again accelerating, said clothes basket, to said first predetermined rotational speed;

determining whether said clothes basket reaches said second predetermined rotational speed within another predetermined time from reaching said first predetermined rotational speed; and responsive to said clothes basket not reaching said second predetermined rotational speed within said another predetermined time from reaching said first predetermined rotational speed, determining that said out-of-balance condition exists as to said load of clothing.

15. The method of claim 14, wherein, in said step of determining whether said clothes basket reaches said second predetermined rotational speed within said another predetermined time, said another predetermined time is different than said predetermined time from passing said first predetermined rotational speed in said initial step of determining whether said clothes basket reaches said second predetermined rotational speed within said predetermined time from passing said first predetermined rotational speed.

* * * * *

UNITED STATES PATENT AND TRADEMARK OFFICE

CERTIFICATE OF CORRECTION

PATENT NO. : 8,499,392 B2
APPLICATION NO. : 12/869190
DATED : August 6, 2013
INVENTOR(S) : Suel, II et al.

It is certified that error appears in the above-identified patent and that said Letters Patent is hereby corrected as shown below:

In the specification

In Column 2, Line 42, delete “way,” and insert -- way --, therefor.

In the claims

In Column 12, Line 62, in Claim 11, delete “axis” and insert -- axis, --, therefor.

In Column 13, Line 21, in Claim 11, delete “time” and insert -- time; --, therefor.

In Column 14, Line 23, in Claim 13, delete “containing,” and insert -- containing --, therefor.

In Column 14, Line 53, in Claim 14, delete “accelerating,” and insert -- accelerating --, therefor.

Signed and Sealed this
First Day of December, 2015

Michelle K. Lee

Michelle K. Lee
*Director of the United States Patent and Trademark Office*